United States Patent [19]

Helms

[11] 4,158,515

[45] Jun. 19, 1979

[54] METHOD AND APPARATUS FOR ELEVATING LOAD-BEARING ACCESS DEVICES

[76] Inventor: William R. Helms, 620 E. Holly, Goldsboro, N.C. 27530

[21] Appl. No.: 882,548

[22] Filed: Mar. 2, 1978

Related U.S. Application Data

[63] Continuation of Ser. No. 819,923, Jul. 28, 1977, abandoned.

[51] Int. Cl.[2] ..... E02D 29/14

[52] U.S. Cl. ..... 404/72; 404/26; 210/164; 52/20

[58] Field of Search ..... 404/26, 25; 52/19, 20, 52/21; 210/163, 164

[56] References Cited

U.S. PATENT DOCUMENTS

| | | | |
|---|---|---|---|
| 2,431,082 | 11/1947 | Sayles | 404/26 |
| 2,593,918 | 4/1952 | Redman | 404/26 |
| 3,240,133 | 3/1966 | Ross | 404/26 |
| 3,385,011 | 5/1968 | Sorrell | 52/19 |
| 3,408,778 | 11/1968 | Mason | 404/26 X |
| 3,891,337 | 6/1975 | McCoy | 404/26 |

FOREIGN PATENT DOCUMENTS

| | | | |
|---|---|---|---|
| 276081 | 6/1967 | Australia | 404/26 |
| 789542 | 1/1958 | United Kingdom | 404/26 |

*Primary Examiner*—Nile C. Byers, Jr.
*Attorney, Agent, or Firm*—Fred Philpitt

[57] ABSTRACT

This invention pertains to a method and apparatus whereby, when a thoroughfare is to be resurfaced, the covers for the openings that extend downwardly beneath such thoroughfares may be raised to a level corresponding to the raised level of the resurfaced thoroughfare. Such raising is accomplished without the need for digging up the framework that supported the cover.

8 Claims, 6 Drawing Figures

METHOD AND APPARATUS FOR ELEVATING LOAD-BEARING ACCESS DEVICES

This is a continuation of application Ser. No. 819,923, filed July 28, 1977 now abandoned.

BACKGROUND

Most paved thoroughfares overlie water lines, sewer lines and conduit systems for the distribution of electricity, gas, steam, and/or communications. Access to these below-surface facilities is usually provided by a vertical opening which is capped by a cover or grate that is level with the top of the thoroughfare. The cover or grate usually rests upon a supporting framework. The supporting framework is either embedded in the paved thoroughfare or rests on a foundation either in or below the paved thoroughfare.

When it becomes necessary to resurface this thoroughfare a layer of new material, usually asphalt, is simply applied to the top of the old thoroughfare. The cover or grate must then be raised to correspond to the new surface level. In the past this raising has been achieved by either digging up the supporting framework and re-embedding it (which is expensive in terms of labor and creates definite safety hazards or by placing some sort of an elevating device between the embedded framework and the cover (which often involves a number of structural problems and other limitations and in particular the inability of such extensions to be used along with the existing cover or grate when the new surface level is less than the thickness of the cover or the grate plus approximately ½ inch).

For a long time the art has needed a new method and/or apparatus which will permit such covers or grates to be elevated without digging up the support frames and without the height limitations inherent in prior art extensions.

THE PRESENT INVENTION

Considered from one aspect, the present invention involves a method for initially supporting a load-bearing access device in a supporting means so that the top of the load-bearing access device is substantially level with the surrounding road surface and subsequently, when the level of the road surface is to be raised, providing a modified supporting means so that when the load-bearing access device is remounted therein the top of the load-bearing access device will be substantially level with the raised road surface, which method comprises the steps of (a) arranging the supporting means in a fixed position in the roadway, said supporting means comprising in combination (1) a generally ring-shaped frame member that includes:

(A) an upper rim surface that is placed so that it is approximately level with the level of the roadway, (B) an annular shoulder support surface located inwardly and below said upper rim surface and disposed generally parallel thereto, said shoulder support surface consisting of an outer portion and an inner portion, and (C) an inner generally vertical side wall interconnecting said upper rim surface and said shoulder support surface, and (2) a generally ring-shaped insert member comprising an upper surface, a lower bearing surface, and two side walls interconnecting said upper and lower surfaces, said lower bearing surface of said insert member resting upon said outer portion of the said shoulder support surface of said ring-shaped frame member, (b) placing a load-bearing access device in said supporting means so that the lower circumferential rim of said access device rests on said inner portion of said annular shoulder surface of said ring-shaped frame member, (c) removing said access device and said ring-shaped insert member when the level of the roadway is to be raised, (d) disposing an extension member on and within said ring-shaped frame member to thereby produce a modified supporting means, said extension member (1) having on its lower side a bearing surface that rests upon and is supported by at least said outer portion of said shoulder support surface, and (2) having on its upper side a load support surface that approximately corresponds to the area of the inner portion of said shoulder support surface and is parallel thereto, (e) replacing said access device in said modified supporting means so that the lower circumferential rim of said access device bears against the said upper side of said extension member.

Considered from another aspect this invention pertains to apparatus, including combinations and subcombinations for carrying out the above method.

The load-bearing access devices to which the present invention is applicable includes manhole covers, catch basin grates, valve box covers, junction box covers, trenchway grates, monument covers, and any and all such access devices by whatever name which are used in conjunction with a supporting frame member embedded in or through a paved thoroughfare and supported by a foundation either in or below the paved thoroughfare for the purpose of supporting vehicular traffic loading and which are removable to provide access to underground structures or operational devices or conduits or sluiceways or sandtraps located below the top surface of the paved thoroughfare. These access devices, together with their supporting frames, may be round, oval, square, rectangular, triangular or any other geometric plane configuration. Because a manhole cover is probably one of the best known and most widely used load-bearing access devices, the drawings and the following detailed description are directed to a manhole cover as the load-bearing device, and it should be understood that this has merely been done for exemplary purposes and not by way of limitation.

The invention will be more clearly understood by reference to the following detailed description when read in conjunction with the attached drawings wherein:

FIG. 1 is a perspective view of the four structural elements that are useful in connection with the practice of my method. These elements are the manhole cover C, the extension member E, the ring-shaped insert member I and the ring-shaped frame member F.

Figure 2:
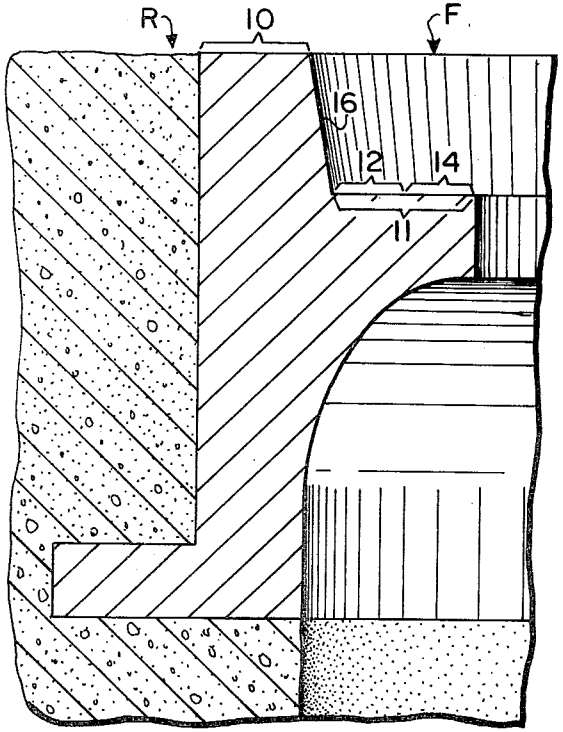

Referring to FIG. 2, the first step in my method is to initially arrange a generally ring-shaped frame member F in a fixed position in the roadway. Frame member F has an upper rim surface 10 that is placed so that it will be approximately level with the level of the roadway R. Frame member F also has an annular shoulder support surface 11 consisting of an outer portion 12 and an inner portion 14, these portions 12 and 14 being concentric with respect to each other. Shoulder support surface 11 is located inwardly and below said upper rim surface 10. This shoulder surface 11 is also generally parallel to said upper rim surface 10. A side wall 16 interconnects said upper rim surface 10 and said shoulder support surface 11.

Figure 3:
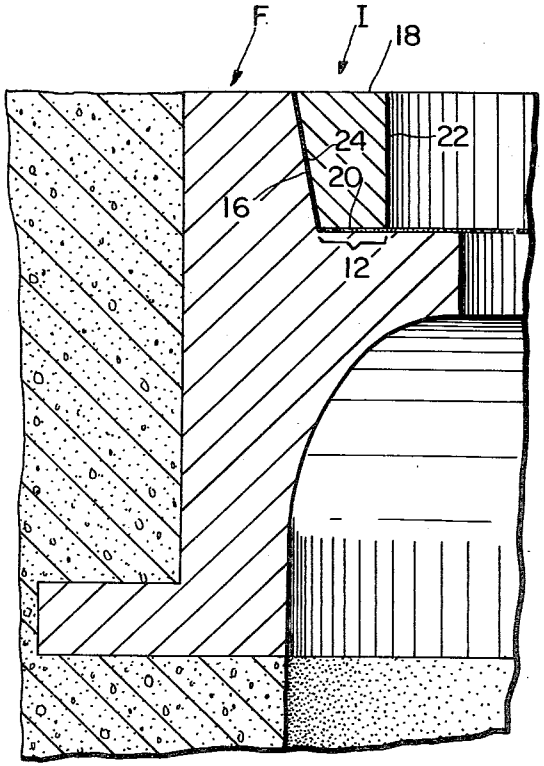
FIGS. 2–6 are sequential sectional views illustrating the placement of the several components in accordance with this invention.

Referring to FIG. 3, in accordance with my method the frame member F should be used in connection with a generally ring-shaped insert member I in order to form what I prefer to refer to as a manhole supporting means. In FIG. 3 it will be seen that member I is composed of an upper surface 18, a lower bearing surface 20, and two side walls 22 and 24 interconnecting said surfaces 18 and 20. The lower bearing surface 20 of said insert member rests upon the outer portion 12 of the aforesaid shoulder support surface 11. The insert member can be made of either cast iron, steel, other metals, hard rubber, a tough plastic (e.g. PVC), fiberglass, or any other structural material and is preferably in the position shown with respect to frame member F at the time that the frame member F is placed in a fixed position in the roadway. Frame F and insert member I are preferably bonded together along surfaces 16–24 and 20–12 by means of a tarry or asphaltic medium, or by any other type of suitable adhesive or cement. They may also be held together by pins, rivets, bolts or the like, or they can be lightly tack welded at spaced apart points or even drive fitted together. However, since these two members will have to be separated at some later time, they should not be attached together in such a way that separation becomes exceedingly difficult or time-consuming. Although it is preferred that members F and I be installed in the roadway as a composite unit, it would also be possible, but less preferable, to first install member F in the roadway and then install member I.

Figure 4:
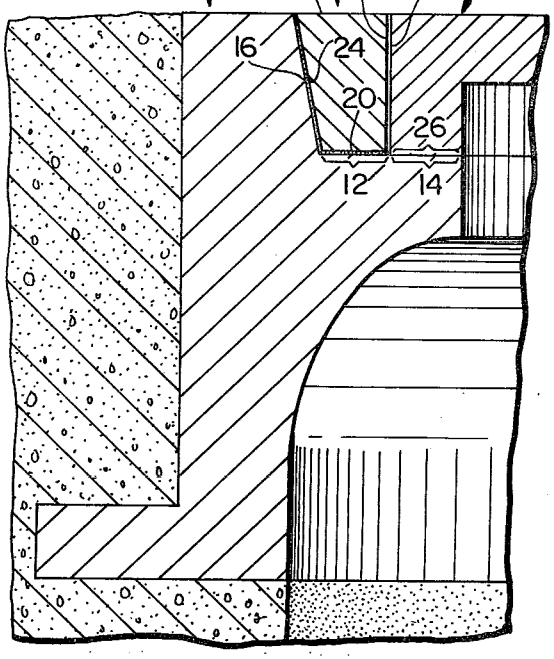

In the next step of my process (see FIG. 4) a manhole cover C is put in place. It will be noted that the lower circumferential rim 26 of the manhole cover C rests on the inner portion 14 of the annular shoulder surface 11. The manhole cover of FIG. 4 will thus be quite suitably supported and will perform well under the loads and stresses imposed by traffic. The outer side wall 32 of the cover parallels the inner side 22 of the insert member, but sufficient space is left therebetween so that the cover C can be lifted out by workmen without a great deal of difficulty.

Figure 1:
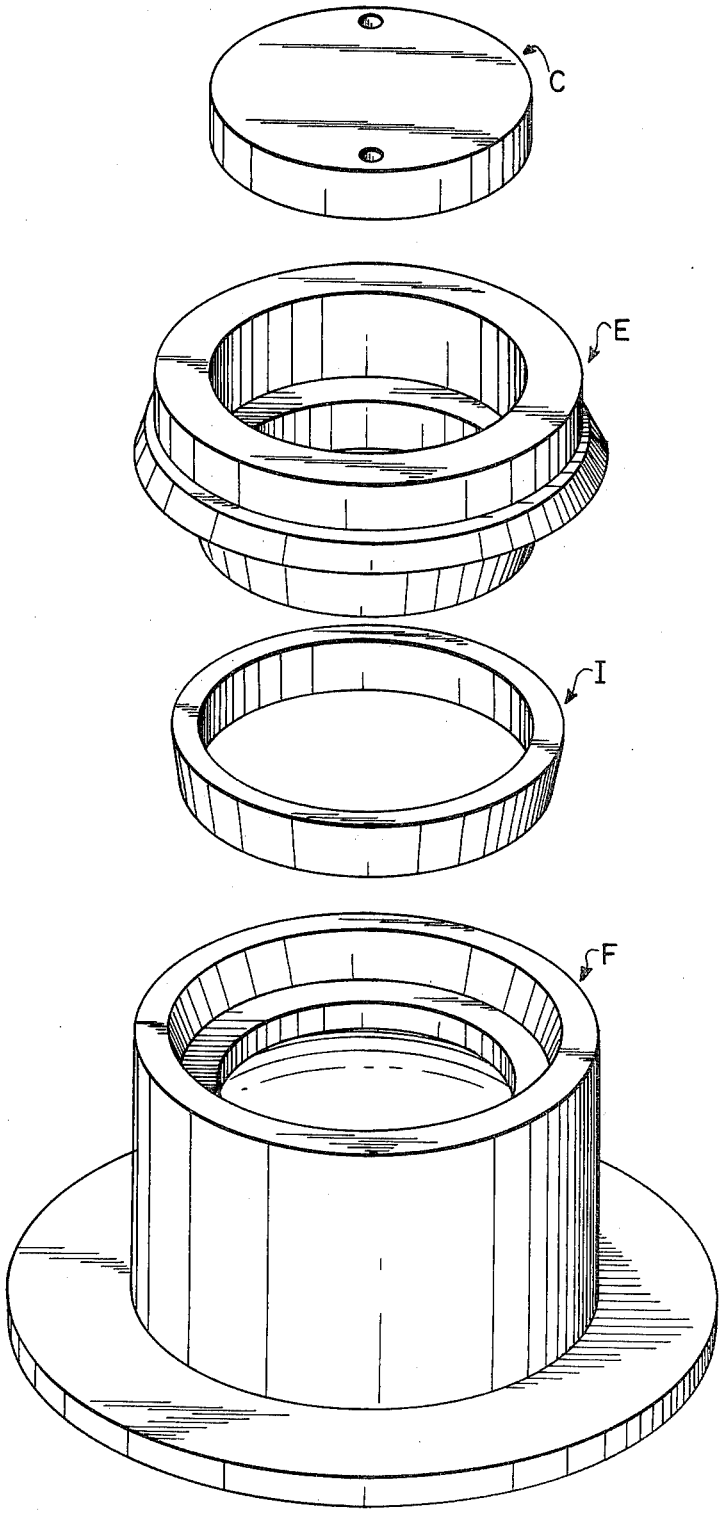
FIG. 1 is a perspective view of the various components that make up the present invention.

When it becomes desirable to resurface the roadway, for instance by adding a one inch layer of asphalt, something must be done to elevate the manhole cover so that its top surface will be one inch higher. In accordance with my method, the cover C is first removed. Next the insert member I is removed, usually by prying it out with a crowbar or similar prying tool. The lower bearing surface 20 is preferably made so that it has one or more spaced apart notches, slots, holes of indentations which will accomodate the pointed end of a crowbar, lever or prying tool and thus facilitate the prying out of said insert member. After the cover C and the insert member I have been removed, the only thing that remains is the frame member F (i.e. the condition shown in FIG. 1).

Figure 5:
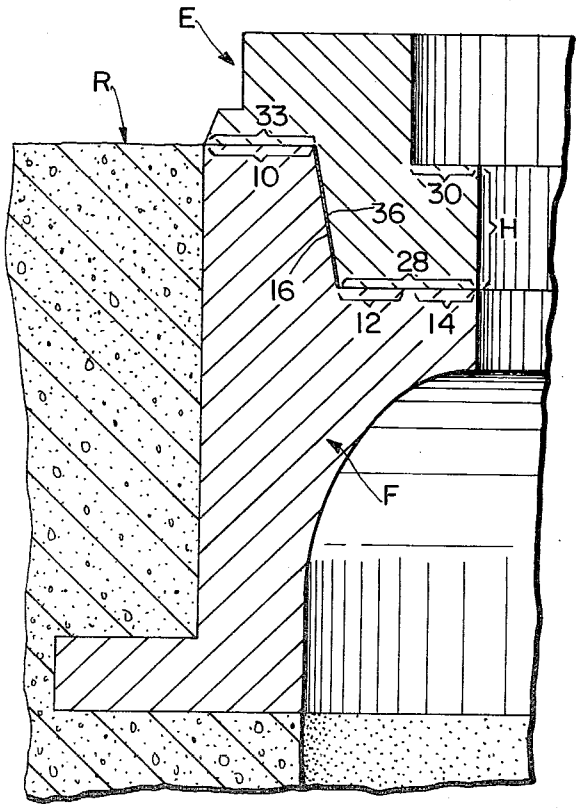

The next step is to place an extension member E on and within said ring-shaped frame member F, as is indicated in FIG. 5. It will be noted that the lowermost surface 28 of the extension member E rests upon and is supported by at least the outer portion 12 of the shoulder support surface 11. The phrase "at least" is used because inner portion 14 of the shoulder support surface 11 may also support the bearing surface 28, depending upon the amount of wear that said inner portion has been subjected to. If the roadway is resurfaced only a short time after the manhole cover and manhole frame have been put down, then inner portion 14 ordinarily receives little wear and is in the same plane as outer portion 12. However, if the roadway is resurfaced sometime after the manhole cover frame was put down, or even if the manhole cover has been subjected to hard wear for only a short period of time, the chances are that inner portion 14 will have been worn down so that it is not in the same plane as the outer portion 12. In such a case only the outer portion 12 can be said to be really supporting the lower-most surface 28 of the extension member E. In any event, an important advantage of my construction is that *regardless* of either time or wear, my extension member always has a perfectly level and unworn surface to bear upon (i.e. outer portion 12), thus insuring proper interfitting of the frame member F and the extension member E.

The upper side 30 of the extension member E constitutes a load-bearing surface that preferably closely approximates the area of said inner portion 14. An outer portion 33 of the extension member E rests on or near the upper rim surface 10 of the frame member F.

Figure 6:
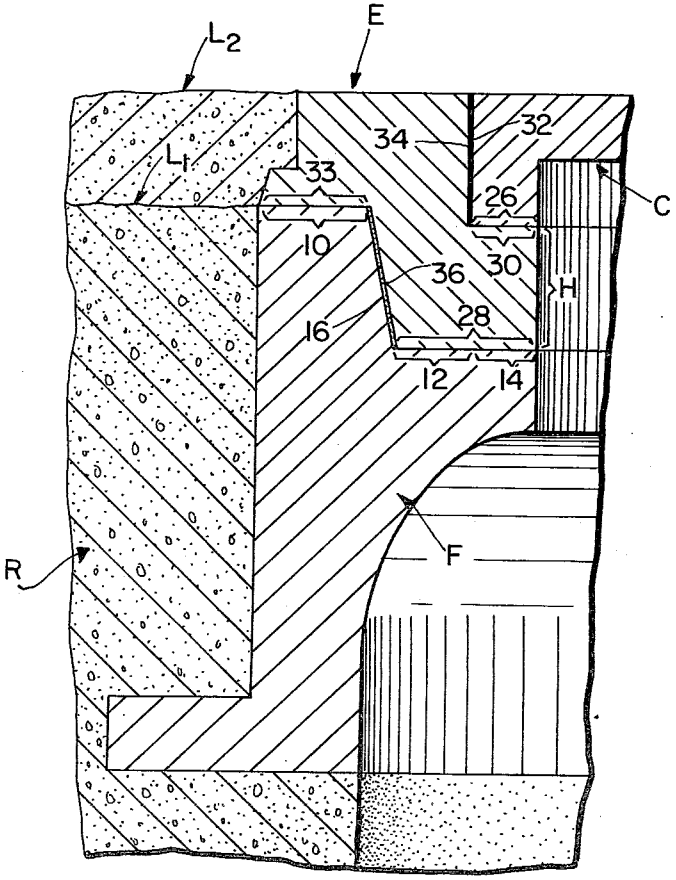

Once the extension member E is in place the level of the roadway can be raised from $L_1$ to $L_2$ by resurfacing with asphalt, concrete, or any other suitable resurfacing material (see FIG. 6).

Lastly, the manhole cover C is replaced on the modified supporting means shown in FIg. 5 to achieve the arrangement shown in FIG. 6. In FIG. 6 it will be noted that the lower circumferential rim 26 of the cover C bears down against the upper side 30 (i.e. the load bearing surface) of the extension member E. The outer side 32 of the cover C parallels the inner side 34 of the extension member, but with enough space therebetween to permit easy removal. The manhole cover is thus presented with a new bearing surface that is perfectly level, and structurally sound.

The precise configuration of the various components of my invention are not critical. For example, surfaces 16, 24 and 36 can be perfectly vertical rather than inclined. Surfaces 22, 32 and 34 can be inclined rather than perfectly vertical. Surfaces 10 and 18 are preferably horizontal, but could be inclined or rounded for some applications. The unnumbered surfaces of the frame member F and the extension member E are not critical insofar as the present invention is concerned and may be varied from that shown in the drawings. A critical aspect of my invention is that the shoulder support surface 11 must be wider than the width of the rim 26 of the cover C and preferably at least 50%.

It is seen that with my invention it is possible to raise the level of the manhole cover C any desired height by simply replacing insert member I with an extension member E having a dimension H which is equal to the exact amount of elevation desired.

The extension member E in accordance with this invention is preferably bonded to the frame member F in any of the various ways that the insert member I was bonded to the frame member F. Also, if desired, the extension member may similarly be provided with notches, slots or holes to facilitate removal when this becomes necessary.

If a second resurfacing of a thoroughfare becomes necessary, the extension member used for the first resurfacing may be removed and replaced with a second extension member that will raise the manhole cover to the new desired level. An important advantage of my invention is that the second extension member will be seated (at least) on the unworn outer portion 12 of the support frame.

In conclusion, while there has been illustrated and described a preferred embodiment of my invention, it is to be understood that since the various details of construction many obviously be varied considerably without really departing from the basic principles and teachings of this invention, I do not limit myself to the precise constructions herein disclosed and the right is specifically reserved to encompass all changes and modifications coming within the scope of the invention as defined in the appended claims.

Having thus described my invention, which I claim as new and desire to secure a United States Letters Patent on is:

1. A load bearing access device and supporting means which comprises in combination (1) a generally ring-shaped frame member that includes (A) an upper rim surface that is adapted to be placed so that it is approximately level with the level of a roadway, (B) an annular shoulder support surface located inwardly and below said upper rim surface and disposed generally parallel thereto, said shoulder support surface consisting of an outer seating surface and an inner seating surface, and (C) an inner generally vertical side wall interconnecting said upper rim surface and said shoulder support surface, (2) a generally ring-shaped insert member comprising an upper surface, a lower bearing surface, and two side walls interconnecting said upper and lower surfaces, said lower bearing surface of said insert member only resting upon said outer seating surface of the said shoulder support surface of said ring-shaped frame member, and (3) a load bearing access device having an external diameter that is slightly less than the inside diameter of said insert member, said access device being adapted to rest upon said inner seating surface of said annular shoulder support surface of said ring-shaped frame member within the inner circumference of said insert member.

2. A supporting means for a load-bearing access device which comprises in combination:

(1) a generally ring-shaped frame member that includes (A) an upper rim surface that is adapted to be placed so that it is approximately level with the level of a roadway, (B) an annular shoulder support surface located inwardly and below said upper rim surface and disposed generally parallel thereto, said shoulder support surface consisting of an outer seating surface and an inner seating surface, and (C) an inner generally vertical side wall interconnecting said upper rim surface and said shoulder support surface, and (2) a generally ring-shaped insert member comprising an upper surface, a lower bearing surface, and two side walls interconnecting said upper and lower surfaces, said lower bearing surface of said insert member only resting upon said outer seating surface of the said shoulder support surface of said ring-shaped frame member, said inner seating surface of said annular shoulder surface of said ring-shaped frame member being out of contact with said insert member and being adapted to serve as a seat for a load bearing access device.

3. An elevated load bearing access device and supporting means therefore which comprises in combination (1) a generally ring-shaped frame member that includes (A) an upper rim surface that is adapted to be placed so that it is approximately level with the level of a roadway, (B) an annular shoulder support surface located inwardly and below said upper rim surface and disposed generally parallel thereto, said shoulder support surface consisting of an outer seating surface and an inner seating surface, and (C) an inner generally vertical side wall interconnecting said upper rim surface and said shoulder support surface, and (2) an extension member seated on and within said ring-shaped frame member, said extension member (A) having on its lower side a bearing surface that rests upon and is supported by at least said outer seating surface of said shoulder support surface, (B) having on its upper side a load support surface that approximately corresponds to the area of said inner seating surface of said shoulder support surface and which is parallel thereto, and (3) a load bearing access device seated on said load support surface of said extension member.

4. An apparatus according to claim 1 or 2 or 3 wherein said load bearing device is a manhole cover.

5. An apparatus according to claim 1 or 2 or 3 wherein said insert member is composed of a tough plastic.

6. A method for initially supporting a load-bearing access device in a supporting means so that the top of the access device is substantially level with the surrounding road surface and subsequently, when the level of the road surface is to be raised, providing a modified supporting means so that when the access device is remounted therein the top of the access device will be substantially level with the raised road surface, which method comprises the steps of (a) arranging a supporting means in a fixed position in the roadway, said supporting means comprising in combination (1) A generally ring-shaped frame member that includes:

(A) an upper rim surface that is placed so that it is approximately level with the level of the roadway, (B) an annular shoulder support surface located inwardly and below said upper rim surface and disposed generally parallel thereto, said shoulder support surface consisting of an outer seating surface and an inner seating surface, and (C) an inner generally vertical side wall interconnecting said upper rim surface and said shoulder support surface, and (2) a generally ring-shaped insert member comprising an upper surface, a lower bearing surface, and two side walls interconnecting said upper and lower surfaces, said lower bearing surface of said insert member resting upon said outer seating surface of the said shoulder support surface of said ring-shaped frame member, (b) placing a load-bearing access device in said supporting means so that the lower circumferential rim of said access device rests on said inner seating surface of said annular shoulder surface of said ring-shaped frame member, (c) removing said access device and said ring-shaped insert member when the level of the roadway is to be raised, (d) disposing an extension member on and within said ring-shaped frame member to thereby produce a modified supporting means, said extension member (1) having on its lower side a bearing surface that rest upon and is supported by at least said outer seating surface of said shoulder support surface, and (2) having on its upper side a load support surface that approximately corresponds to the area of the inner seating surface of said shoulder support surface and is parallel thereto.

(e) replacing said access device in said modified supporting means so that the lower circumferential rim of said access device bears against the said upper side of said extension member.

7. A method according to claim 6 wherein said load bearing device is a manhole cover.

8. A method according to claim 6 wherein said insert member is composed of a tough plastic.

* * * * *